United States Patent [19]

Chen

[11] Patent Number: 5,074,445

[45] Date of Patent: Dec. 24, 1991

[54] GARMENT HANGER WITH SWIVEL HOOK AND GANGING HOOK

[76] Inventor: Chia-Sing Chen, 2F, No. 128, Sec. 2, Cheng Kung Rd., Yung Ho City, Taipei Hsien, Taiwan

[21] Appl. No.: 574,037

[22] Filed: Aug. 29, 1990

[51] Int. Cl.[5] ..... A47G 25/18; A47G 25/14

[52] U.S. Cl. ..... 223/85; 223/92; 223/95; 223/DIG. 4; 223/88; 248/278; 211/116

[58] Field of Search ..... 223/DIG. 3, 85, 88, 223/92, 95, DIG. 4; 403/165, 78, 53; 211/115, 116, 170, 168, 172; 248/278, 215

[56] References Cited

U.S. PATENT DOCUMENTS

| | | | |
|---|---|---|---|
| 1,938,643 | 12/1933 | Smith | 403/53 X |
| 2,456,003 | 12/1948 | Knutsou | 248/278 X |
| 2,551,136 | 5/1951 | Keltner | 403/53 X |
| 2,634,032 | 4/1953 | Bartlett | 211/170 |
| 2,694,585 | 11/1954 | Fiori | 403/53 X |
| 2,779,479 | 1/1957 | Cohen | 403/165 |
| 2,914,227 | 11/1959 | Fay | 223/92 |
| 3,084,894 | 4/1963 | Koenen | 248/278 |
| 3,289,985 | 12/1966 | Sheiman | 223/85 |
| 3,485,423 | 12/1969 | Wagar et al. | 223/85 |
| 3,702,166 | 11/1972 | Jaffe | 211/115 |
| 4,337,020 | 3/1983 | Vigo | 403/53 X |
| 4,669,907 | 6/1987 | Patton | 403/78 |
| 4,836,485 | 6/1989 | Cooper | 248/278 |
| 4,871,198 | 10/1989 | Bredweg et al. | 223/92 |
| 4,981,242 | 1/1991 | Grahm | 223/85 X |

FOREIGN PATENT DOCUMENTS

| | | | |
|---|---|---|---|
| 0144653 | 10/1984 | European Pat. Off. | 223/85 |
| 3426593 | 1/1986 | Fed. Rep. of Germany | 223/85 |
| 803754 | 10/1958 | United Kingdom | 223/85 |

*Primary Examiner*—Andrew M. Falik
*Assistant Examiner*—Bibhu Mohanty
*Attorney, Agent, or Firm*—Varndell Legal Group

[57] ABSTRACT

A garment hanger comprises a hook member coupled with a garment supporting frame by a pivot joint. The hook member can be rotated within a fixed degree of angle relative to the garment supporting frame so that the garment hanger can be conveniently hung on a clothes-line for holding a garment to keep it in shape. Several garment hangers can be connected in series by a hook joint, for holding several garments, to reduce space occupation.

2 Claims, 2 Drawing Sheets

GARMENT HANGER WITH SWIVEL HOOK AND GANGING HOOK

BACKGROUND OF THE INVENTION

The present invention is related to garment hangers and more particularly to a garment hanger for holding a garment to keep it in shape, which has a swivel hook member which can be rotated within a fixed degree of angle to facilitate the mounting of a garment hanger on a clothes-line or clothes-rod.

A garment hanger is device for holding a garment to keep it in shape. There are various types of garment hangers commonly used for holding garments. However, the conventional types of garment hangers are not satisfactory in use. A conventional garment hanger may be easily deformed when a heavy garment is hung thereon, if it is made of an iron wire sleeved with a plastic tube. While hanging a conventional garment hanger on a clothes-line or clothes-rod, the garment (more particularly the pants) on the garment hanger may slide aside to wrinkle its shape and it must be rearranged properly. Another disadvantage of the conventional garment hangers is that two or more garment hangers can not be connected in series for use in a narrow place for holding several garments in shape.

SUMMARY OF THE INVENTION

One object of the present invention is to provide a garment hanger which has a hook member which can be rotated within a fixed degree of angle to facilitate its mounting on a clothes-line or clothes-rod while keeping a garment in shape.

Another object of the present invention is to provide a garment hanger which has a means such that several garment hangers of the same structure can be conveniently connected in series for keeping a garment each to minimize space occupation without causing any disturbance.

According to the present invention, a garment hanger comprises a hook member pivotably connected to a garment supporting frame through a pivot joint. The pivot joint has a hooked portion, on which the hook member of another garment hanger can be hung, and a first tubular connection transversely disposed at two opposite ends at the top, and a second tubular connection vertically disposed at the bottom. The hook member has an eye end at the bottom for catching the first tubular connection, which eye end has a curved projection at one side for confining the moving range of the hook member on the first tubular connection within a fixed degree of angle. The garment supporting frame has an eye end at one end for catching the second tubular connection.

BRIEF DESCRIPTION OF THE DRAWINGS

The present invention will now be described by way of example with reference to the annexed drawings, in which.

DETAILED DESCRIPTION OF THE PREFERRED EMBODIMENTS

Figure 1:
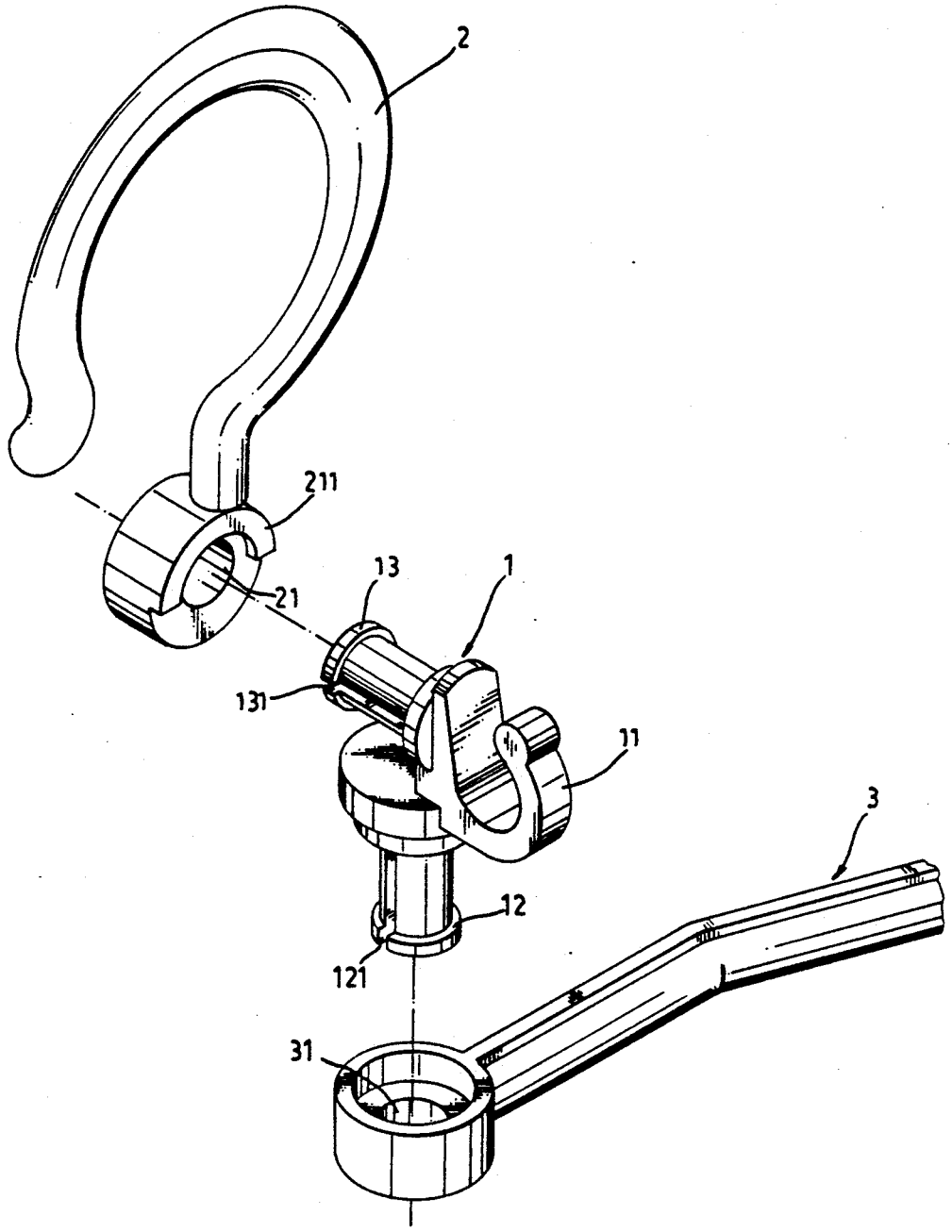
FIG. 1 is a perspective dismantled view of the hook and a portion of the crossbar of the preferred embodiment of the present invention.

Referring to FIG. 1, a garment hanger of the present invention generally comprises a hook member 2 connected with a substantially V-shaped garment supporting frame 3 through a pivot joint 1.

As illustrated, a pivot joint 1 comprises a hooked portion 11 and a first tubular connection 13 transversely disposed at two opposite ends at the top, and a second tubular connection 12 vertically disposed at the bottom. The first and second tubular connections 13, 12 are each split into two semi-circular parts by an elongated slit 131 and 121. A hook member 2 of the present invention has an eye end 21 at the bottom for catching the first tubular connection 13 of the pivot joint 1 (see FIG. 2). According to the present invention, a V-shaped garment supporting frame 3 has an eye end 31 at one end for catching the second tubular connection 12 of the pivot joint 1 and a clip 32 at an opposite end for retaining the garment which is hung on the transverse rod portion 33 of the garment supporting frame 2.

Figure 2:
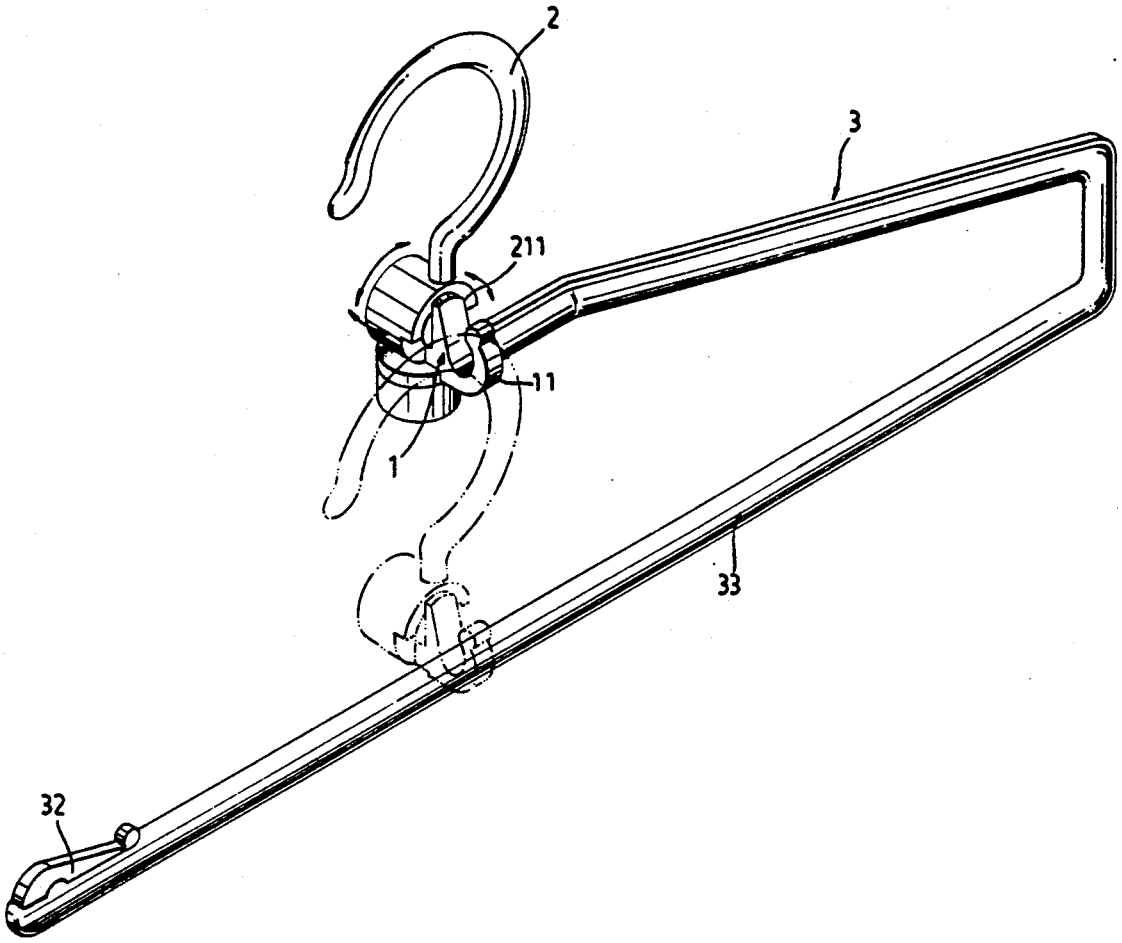
FIG. 2 is a schematic drawing, illustrating the moving range of the hook member on the pivot joint and the connection of one garment hanger with another.

Referring to FIG. 2, the eye end 21 of the hook member 2 has a curved projection 211 at one side which confines the moving range of the hook member 2 relative to the first tubular connection 13 of the pivot joint 1. When in use, the hook member 2 can be rotated forward and backward to facilitate the mounting of the garment supporting frame 3 on a clothes-line or clothes-rod (not shown). Several garment hangers of the present invention may be conveniently connected in series for holding several garments orderly, with the hook member 2 of one garment hanger hung on the hooked portion 11 of the pivot joint 1 of another.

I claim:

1. A garment hanger comprising a pivot joint having first and second tubular connections, said first tubular connection extending transverse to said second tubular connection, said second tubular connection extending in a vertical direction, said first and second tubular connections each having a longitudinally extending slit formed therethrough, a hook member having an eye end at the bottom thereof for receiving said first tubular connection, said eye end having a curved projection at one side for limiting the range of movement of said hook member relative to said first tubular connection, and a garment supporting frame for keeping a garment in shape, said garment supporting frame having an eye end thereon for receiving said second tubular connection.

2. A garment hanger comprising a pivot joint having an upper and a lower portion and including an upwardly opening hooked portion for receiving and supporting a hook member of a cooperating hanger, said pivot joint further including a horizontally extending first tubular connection at the upper portion thereof and a vertically extending second tubular connection at the lower portion thereof, each of said tubular connections having a longitudinally extending slit formed therethrough, said first and second tubular connections being connected in fixed relationship to one another, a hook member including an upper and a lower portion, the hook member having an eye opening at the lower portion thereof receiving said first tubular connection so that said hook member can rotate about said first tubular connection, said lower portion of the hook member also including a projection at one side having opposite ends for engaging said pivot joint to limit the range of rotation of said hook member relative to said first tubular connection, and a garment supporting frame for keeping a garment in shape, said garment supporting frame having opposite ends, an eye opening at one end of said garment supporting frame for receiving said second tubular connection to support the garment supporting frame from said pivot joint.

* * * * *